United States Patent [19]

Takemura et al.

[11] 4,204,031

[45] May 20, 1980

[54] IRON-BASE SINTERED ALLOY FOR VALVE SEAT AND ITS MANUFACTURE

[75] Inventors: Kazutoshi Takemura; Takashi Oda; Fumio Kiyota, all of Kashiwazaki, Japan

[73] Assignee: Riken Corporation, Tokyo, Japan

[21] Appl. No.: 855,964

[22] Filed: Nov. 30, 1977

[30] Foreign Application Priority Data

| | | | |
|---|---|---|---|
| Dec. 6, 1976 | [JP] | Japan | 51-145662 |
| Apr. 4, 1977 | [JP] | Japan | 52-37637 |
| Mar. 28, 1977 | [JP] | Japan | 52-33284 |

[51] Int. Cl.[2] ..... C22C 1/10

[52] U.S. Cl. ..... 428/539.5; 75/200; 75/231; 75/243; 75/246; 427/295; 427/435

[58] Field of Search ..... 75/200, 243, 231, 246; 427/295, 435; 428/539.5, 566

[56] References Cited

U.S. PATENT DOCUMENTS

| | | | |
|---|---|---|---|
| 2,376,706 | 5/1945 | Lum | 427/295 X |
| 3,918,923 | 11/1975 | Inoue | 75/246 X |
| 3,982,905 | 9/1976 | Osawa et al. | 75/243 X |
| 3,982,907 | 9/1976 | Honma | 75/246 X |
| 4,021,205 | 5/1977 | Matsuda et al. | 75/246 |
| 4,080,205 | 3/1978 | Niimi et al. | 75/246 X |

FOREIGN PATENT DOCUMENTS

| | | | |
|---|---|---|---|
| 2500662 | 7/1975 | Fed. Rep. of Germany | 75/246 |

*Primary Examiner*—Richard E. Schafer

[57] ABSTRACT

A novel group of iron-base sintered alloys especially suitable for valve seat manufacture having excellent wear resistance and good machinability is provided. The alloy is produced by a combination of specific atomized pre-alloyed powder, iron powder and graphite powder by compacting and sintering processes. Various manufacturing methods with or without infiltration of filler materials into pores in the sintered product to improve wear resistance and machinability are disclosed.

8 Claims, 7 Drawing Figures

IRON-BASE SINTERED ALLOY FOR VALVE SEAT AND ITS MANUFACTURE

FIELD OF THE INVENTION

The present invention relates generally to an improvement on sintered alloy for valve seat in an internal combustion engine, and particularly to such alloy having excellent wear resistance to repetitive hot impacts and good machinability. The present invention further relates to manufacturing method of a group of such alloys.

DESCRIPTION OF THE PRIOR ART

With the recent trend in a design of internal combustion engines in which they have been gradually small-sized and powered-up while unleaded gasoline or LPG has been increasingly used, the valve seat is subject to hot impact with a valve body at a temperature of 700°-800° C., and therefore the valve seat is presently required of a high wear resistance to such a severe condition.

Furthermore, since mechanical processes are performed on the valve seat inlaid in the cylinder head to form a precise contact surface against the mating valve body, a good machinability is also required.

On the other hand, prior iron-base sintered alloys which have been developed and used for primarily valve seat material, and in which metal molybdenum, ferro-molybdenum or hard metal is dispersed in the material could not meet the above-mentioned requirements.

SUMMARY OF THE INVENTION

The object of the present invention is to provide novel iron-base sintered alloys for valve seats satisfying the above-mentioned requirements and to provide manufacturing method of such alloys having excellent mechanical properties. These alloys are characterized in that they comprise pearlite and hard alloy phase in a spherical form of pre-alloyed and atomized powder consisting of 1.0-3.0% (hereinafter in weight %) C, 20-40% Cr, 5-20% W, and balance substantially of Co (hereinafter called as 2C-30Cr-15W-Co alloy) uniformly dispersed in the pearlite. Another object of the present invention is to provide manufacturing method of such alloys.

DETAILED DESCRIPTION OF THE INVENTION

In one aspect of the present invention, the sintered alloy having specific structure comprising pearlite and hard metal or alloy phase in a spherical form of C-Cr-W-Co system, provides an improved wear resistance to repetitive hot impacts. The hard metal phase is composed of 2C-30Cr-15W-Co pre-alloyed powder fabricated by atomization process.

The atomized powder is generally of spherical form, and due to its small contact area with surrounding pearlite in a compacted body, the elements composing the hard phase do not excessively diffuse into the pearlite holding its spherical form, and further prevents so-called Kirkendall effect in which the difference between the diffusion speeds of the pearlite and the hard phase produces a number of voids in the hard phase and forms martensite around these voids.

In the results, the alloys of the present invention inhibits "notch effect" and so-called pitting, i.e. surface tearing-off, under repetitive impacts, and a valve seat formed of the alloy extends the metal mold life and exhibits an excellent mechinability.

Mixed powders of the hard alloy and iron powders has a high fluidity and may be easily compacted into a desired dimension reducing the dimensional fluctuation. Accordingly, the valve seat of the present invention has an economical advantage that valve seats having an inner diameter within a predetermined tolerence may be formed without subsequent mechanical process.

The other features of the present invention may be apparent from the following detailed disclosure in connection with the accompanying drawings in which:

FIG. 1 is a microscopic photograph (X400) showing the structure of the sintered iron-base alloy of the present invention;

FIG. 2 is a microscopic photograph showing the structure of an iron-base sintered alloy produced by the corporation of pulverized 2C-30Cr-15W-Co alloy powder;

FIG. 3 is a schematic illustration of a device for machinability testing;

FIGS. 4 and 5 are graphs showing test results of machinability of products produced by Example 1 of the present invention;

FIG. 6 is a graph showing test results of machinability of products produced by Example 2 and FIG. 7 is a graph showing test results of machinability of products produced by Example 3 of the present invention.

Referring now to the drawings, in FIG. 1 showing a microphotograph (X400), a large white ball is the hard alloy phase in the pearlite, and a number of straggling black dots are voids formed by diffusion of elements in the hard alloy phase during sintering by Kirkendall effect. A small amount of martensite is formed around the surrounding portions of these voids.

FIG. 2 is a microphotograph (X400) of a product produced with mechanically pulverized 2C-30Cr-15W-Co powder. There can be seen a large white hard phase in an irregular form in which several large voids are formed by Kirkendall effect in the hard phase, each encircled by a large amount of martensite. Comparing FIG. 1 with FIG. 2, there can be seen the hard phase of the present invention is of a globular shape whereas the hard phase obtained by the pulverized powder is of an irregular shape. This global shape of the hard phase may be obtained by the use of atomized powder as stated above, and further by a suitable selection of chemical composition to prevent diffusion of ingredient elements in the hard phase during the sintering. This chemical composition of the hard alloy powder will be explained in the following.

Chromium combines with carbon to form carbide. This element, however, easily diffuses during sintering to produce martensite in the surrounding pearlite which impairs machinability, and further generates a number of voids by Kirkendall effect in and around the hard phase which degrades anti-pitting property. In the present invention a considerable amount of cobalt is incorporated to stabilize pearlite and to lower the hardenability, but this amount should be restricted to a range of 20-40%, preferably, 20-35%, to control its diffusion as little as possible to retain the globular form of the hard phase. An amount less than 20% of chromium is insufficient to form the desired amount of carbide, and an amount more than 40% thereof will accelerate the diffusion into the surrounding pearlite producing a number of voids which lowers anti-pitting property and the formed martensite impairs machinability.

Tungsten enhances the hardness of the hard alloy phase by the formation of MC-type carbide and double carbides with cobalt, but an amount less than 5% gives a little effect, and a larger amount will produce an undersirable martensite formation impairing the machinability and increasing product cost; although the hardness is enhanced. Therefore the amount of tungsten should be less than 20%, preferably in a range of 5–15%.

Carbon produces carbides with chromium, tungsten and cobalt in the hard phase and enhances the hardness, and the amount should be restricted in a range 1–3%, because the lesser amount gives a little effect whereas the larger amount produces much amount of carbide which makes products brittle, and when used as valve seat the product tends to subject to tearing-off due to crackings in the hard phase.

Cobalt has an important role that diffusion of chromium and tungsten from the hard phase into pearlite during sintering to form martensite is prevented. The content of cobalt is generally a balance reducing the sum of the above-mentioned carbon, chromium, and tungsten from the total amount of the ingredients, preferably in a range of 40–60%. The amount lesser than 40% is insufficient to prevent the martensite formation, and the amount larger than 60% reduces wear resistance due to the lowered hardness.

To the above-mentioned object, it is necessary to pre-alloy cobalt with chromium and tungsten. If cobalt powder is to be added to mixed powders, not only a large amount of cobalt is required to prevent the martensite formation but also causes decarburization during sintering due to an accelerated diffusion of carbon. While a large amount of cobalt facilitates melting the mixed powder for atomization, for the purpose of improvement of fluidity of the melt for atomization and in view of deoxidation and production cost, 1–5% of cobalt content may be replaced with silicon, nickel or molybdenum, and even less than 10% may be substituted with iron powder.

Composition of the iron-base alloy of the present invention containing global hard phase primarily depends on blending ratio of the ingredients. Specifically, an amount less than 5% of 2C-30Cr-15W-Co powder can not attain the desired wear resistance, and the larger amount deteriorates compactibility, density, wear resistance and machinability of the final product, and therefore the maximum amount of the pre-alloyed powder should be restricted to 20%, the preferred range being 6.5–20%. In this manner, the respective contents in the sintered alloy for valve seat of the present invention are calculated as chromium 1.0–8.0%, tungsten 0.25–4.0%, and cobalt 2.0–12.0%, preferably chromium 1.2–7.0%, tungsten 0.3–3.0%, and cobalt 2.6–12.0%. Further since carbon improves hardness, flextural strength and wear resistance of the sintered alloy, its content should be selected as 0.6–1.5% so that the matrix comprises mainly pearlitic structure. Carbon content less than 0.6% forms primary ferrite rich structure which is insufficient of strength and wear resistance, while the content more than 1.5% makes products brittle.

Thus, the chemical composition of the sintered alloy of the present invention is substantially 0.6–1.5 C, 1.0–8.0% Cr, 0.25–4.0% W, 2.0–12.0% Co, and balance essentially Fe, preferably, 0.6–1.5% C, 1.2–7.0 Cr. 0.3–3.0 W, 2.6–12.0% Co, and balance essentially Fe.

Compacting or consolidating and sintering operations of the alloy of the present invention are carried out in usual manner except sintering temperature and time. In other words, raw material powder having the above-mentioned composition added with an adequate amount of lubricant is charged into a metal mold, compacted at a pressure of 4–7 t/cm$^2$, and sintered at a temperature of 1100°–1180° C. for 30–60 minutes under the vacuum or a reducing atmosphere. Under a temperature below 1100° C. sintering is insufficient and resulting strength is rather low, whereas at a higher temperature chromium and tungsten diffuse out of the hard phase producing a large amount of martensite which impairs machinability. Therefore the maximum sintering temperature is advantageously 1180° C.

Thus iron-base sintered product having a density of 6.5–7.2 g/cc including globular hard alloy phase having micro-Vickers hardness of 500–1200 uniformly dispersed in pearlitic matrix and martensite surrounding said globular hard alloy phase is produced.

When sulfides are formed machinability of the product may be improved. Sulphur of an amount of 0.04–0.4% in the sintered alloy forms a sulfide primarily of iron sulfide which improves machinability of the alloy. As a source of sulphur, a metal sulfide having a high purity and giving no adverse effect in alloying with iron is preferred, and molybdenum disulfide is the most appropriate source. Commercially available iron sulfide is not preferred because it contains a high level of impurities, and zinc sulfide is also not preferred because zinc forms an intermetallic compound with iron and causes a large expansion. Molybdenum disulfide frees sulphur during sintering which combines with iron in the compounded powders to form iron sulfide, and molybdenum in the sulfide diffuses into the pearlite and strengthens said pearlite. Preferred amount of molybdenum disulfide is in a range of 0.1–1%. In view of increase of apparent hardness and decrease of radial crushing strength, a range of 0.3–0.5% is most preferred.

The addition of 0.1–1% molybdenum disulfide results in 0.04–0.4% of sulphur content and 0.06–0.06% of molybdenum content. In this case molybdenum is only a carrier metal for addition of sulphur in pearlite. When iron sulfide phase is dispersed in the pearlite beside the globular hard alloy phase, the resulting composition of the sintered alloy is: 0.6–1.5% C, 1.0–8.0% Cr, 0.5–4.0% W, 2.0–12.0% Co, 0.04–0.4% S, and the balance essentially Fe.

When the cobalt-base alloy, 2C-30Cr-15W-Co alloy, to be used as raw material powder in the sintered alloy of the present invention, contains high content of cobalt, the cost of the resulting product is relatively high. After an extensive experiments, inventors have found that a part of the atomized raw material powder may be replaced by molybdenum powder or low-carbon ferromolybdenum powder with an addition of a small quantity of nickel powder, so that while reduction of wear resistance may be maintained to minimum and the production cost may be appreciably lowered. The sintered alloy of this embodiment includes iron-molybdenum hard phase comprising formed iron-molybdenum carbide, and has a chemical composition of 0.6–1.5% C, 1.2–3.5% Cr, 0.2–2.0% W, 2.0–7.0% Co, 3.0–8.0 Mo, 3.0% maximum Ni, and balance essentially Fe.

Molybdenum may replace a part of an expensive alloy powder, and incorporated in the form of metal molybdenum powder or low-carbon ferromolybdenum powder. The metal molybdenum powder form iron-molybdenum phase by diffusion of matrix iron. The metal molybdenum or low carbon ferromolybdenum further absorbs carbon from the matrix to form double carbide of iron and molybdenum. The iron-molybdenum phase including such a double carbide has micro-Vickers hardness of 600–1300 which improves the wear resistance. The preferred content of molybdenum is 3.0–8.0%, and a higher content thereof deteriorates compactibility and the lower content thereof is insufficient in its effect. Also, use of high-carbon ferromolybdenum powder gives an excessive hardness which causes wear of mating valve and reduces useful life of the metal mold. In this embodiment, a small amount of nickel is added to strengthen the pearlite and to avoid the inherent decrease of wear resistance, but since nickel tends to produce martensite, preferred content of cobalt in this embodiment is 50–70 weight %.

As stated above, the composition of this embodiment varies with the respective contents of 2C-30Cr-15W-Co pre-alloyed and atomized powder and molybdenum or law carbon ferromolybdenum powder. The maximum content of said atomized alloy powder is 20%, and 10% or one-half amount thereof, may be replaced with molybdenum. Thus one embodiment of the sintered alloys of the present invention for valve seat comprises chromium 1.2–3.5%, tungsten 0.2–2.0%, cobalt 2.0–7.0, molybdenum 3.0–8.0%, and balance essentially iron.

Nickel may be added by an amount less than 3% to improve the pearlite strength and to obtain dimensional stability, specifically in a range of 0.5–1.5%.

In accordance with another aspect of the present invention, a filler material may be filled or infiltrated in a number of pores in a sintered product to improve its machinability. The effect of such filling is well-known in the field of the art. On the other hand, when a valve seat is inlaid in a cylinder head, since the seat is previously heated at a temperature approximately 120°–180° C., the melting point of such filler material should have a higher temperature above the above-mentioned range to avoid the melting-off of the material. Also, the operation temperature of such valve seat geneally reach approximately over 300° C., and accordingly the filler material should have a melting temperature less than 300° C. to restore these pores during the operation of an internal combustion engine. The main reason for this restoration of pores is to contribute an improved wear resistance due to a fact that an oxide film comprising $Fe_3O_4$ is formed not only on the surface of the valve seat but also surrounding portion of pores to enhance the apparent hardness and to reduce the coefficient of friction. Specially the existence of pores assists the enhancement of the apparent hardness and stability of the oxide film. Therefore the appropriate range of melting temperature of such filler material should be selected as 120°–250° C.

A suitable group of such filler materials includes special waxes and organic metallic compounds. Recently a wax having a high melting point over 120° C., has been developed, although no wax is found presently having a melting point over 250° C. A wax mixture having a melting temperature not less than 120° C. may be used with any low-melting wax.

A suitable group of organic metallic compounds include stearates of lithium or lead and a mixture thereof.

A suitable infiltrating techinc of the above-mentioned filler material comprises immersing a sintered product in molten filler material of the above-mentioned character, reducing the pressure of the surrounding atmosphere, recovering to the normal pressure then pressurizing the atmosphere to cause infiltration of the molten material into these pores.

Brief Description of the Drawings

Other objects and advantages of the present invention will be apparant from the following description on several examples embodying the present invention in connection with the attached drawings, in which.

Detailed Description of Preferred Embodiments

EXAMPLE 1

Figure 1:
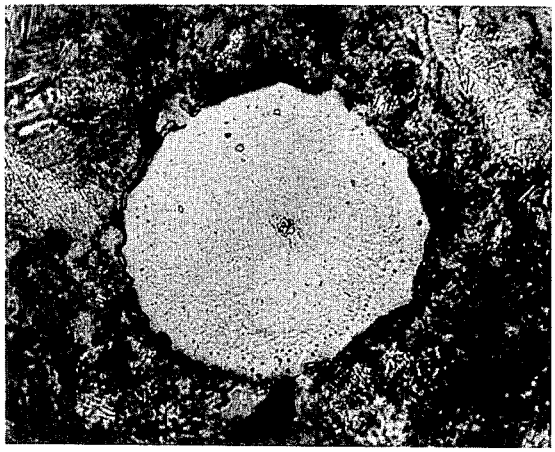
FIG. 1 is a microphotograph showing the structure of a sintered iron-base alloy prepared by the concept of the present invention.
Figure 2:
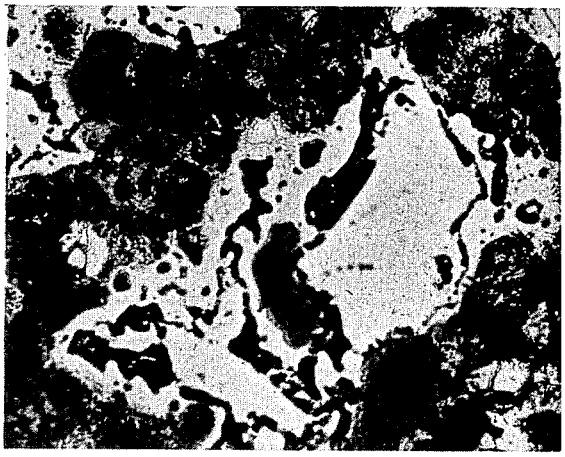
FIG. 2 PRIOR ART
FIG. 2 is a microphotograph showing the structure of a sintered iron-base alloy prepared by incorporation of pulverized 2C-30Cr-15W-Co alloy powder.

Two types of powder, the composition of which being shown in the following Table 1, respectively comprising atomized 2C-30Cr-15W-Co pre-alloyed powder (−100 Mesh) and atomized iron powder (−100 Mesh), are admixed together with graphite powder to give a composition as shown in Table 2. Then 0.6% of zinc stearate powder is added as a lubricant to the mixture and compressed or compacted in a metal mold at a pressure of 6–7 t/cm sq. to give a compact having sintered density of 6.95±0.05 g/cc. The compact is sintered under a vacuum for 50 minutes at a temperature of 1140° C. Rockwell hardness and the radial crushing strength are shown in Table 2.

Table 1 (%)

| Type | C | Cr | W | Si | Mn | Ni | Fe | Co |
|---|---|---|---|---|---|---|---|---|
| I | 2.01 | 27.25 | 8.72 | 1.20 | 1.01 | 0.01 | 0.05 | Balance |
| II | 2.32 | 29.32 | 12.55 | 0.81 | 0.92 | 0.25 | 1.05 | Balance |

Table 2

| | Compounding ratio (%) | | | Apparent hardness | Radial crushing strength | Composition (%) | | | |
|---|---|---|---|---|---|---|---|---|---|
| Sample | Graphite | Alloy | Iron | (HRB) | (Kg/cm Sq.) | C | Cr | W | Co |
| A | 1.2 | (I)11 | Balance | 81 | 61 | 1.01 | 2.98 | 0.97 | 6.60 |
| B | 1.2 | (II)16 | " | 83 | 63 | 1.02 | 4.32 | 1.40 | 9.58 |
| C | 1.2 | (I)12 | " | 83 | 66 | 1.02 | 3.50 | 1.51 | 6.30 |
| D | 1.2 | (II)16 | " | 86 | 68 | 1.03 | 4.68 | 2.00 | 8.43 |

Valve seat samples are prepared with these samples, inlaid as exhaust valve seats on aluminum alloy cylinder head of a water-cooled, four-cycle, 1600 cc of displacement, OHC-type internal combustion engine. Bench tests are carried out using unleaded gasoline, under full-load of 6000 rpm for 100 hours, and wear of valve seats is determined by the recession with respect of standard valve, and simultaneously pitting is observed. Contact surfaces of mating valve have been Stellite coated. The test results are shown in Table 3.

Table 3 (mm)

| Sample | 1st Cylinder | 2nd Cylinder | 3rd Cylinder | 4th Cylinder | Pitting |
|---|---|---|---|---|---|
| A | 0.02 | 0.06 | 0.04 | 0.04 | None |
| B | 0.01 | 0.07 | 0.05 | 0.02 | Slight |
| C | 0.02 | 0.05 | 0.08 | 0.02 | None |
| D | 0 | 0.04 | 0.02 | 0.02 | None |
| T | 0.07 | 0.32 | 0.22 | 0.11 | Observed |
| U | 0.05 | 0.08 | 0.09 | 0.06 | Observed |

Samples T and U are controls of iron-base sintered alloys, specifically T consisting of 1.1% C, 9.8% Mo, 0.29% Ni, and balance Fe, and having a hardness of HRB 93, and U including hard alloy consisting of 2.5% C., 50% Cr, 30% W, and 17.5% Co., said sample U including 15% of pulverized hard alloy powder, graphite powder 1%, Co powder 6% and balance iron powder.

As seen from the above Table 3, it is evident that control samples show large recessions and pitting as compared with samples A–D prepared by the present invention.

Machinability tests are carried out under the following processes. Of the samples subject to the aove-mentioned bench test, samples in cylindrical form for machinability tests (outer diameter 38 mm×inner diameter 29 mm×height 7.5 mm) are prepared using the materials of Sample A, D, T and U. The cylindrical samples A and D are placed in a sealed chamber containing a molten bath having a melting point (mp) of 140° C. of a mixture of zinc stearate and lithium stearate (60:40) at a temperature of 160° C., then vacuum of 10 Torr is applied to the chamber to evacuate the pores in the samples. These samples are dipped in the molten bath by a suitable means to fill the pores with the bath material. Then the pressure in the chamber is raised to 1 kg/cm sq. (gauge) to promote the filling or infiltration into the pores. After resuming the pressure to the normal level, these samples are taken up from the bath and centrifuged to remove the excessive material on the surface. Similar samples A and D are prepared using the other filler material, Ross Wax 160 (mp:158° C.) and Bisamide (mp: 140° C.) at a temperature of 190° C. and under a pressure of 5 Torr. The Samples T and U are filled with only Ross Wax 160.

Figure 3:
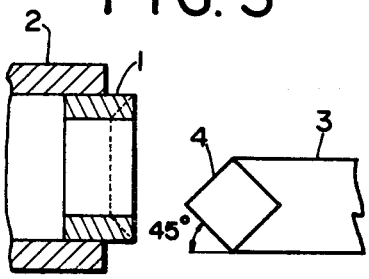
FIG. 3 is a schematic view of an apparatus for machinability testing.
Figure 4:
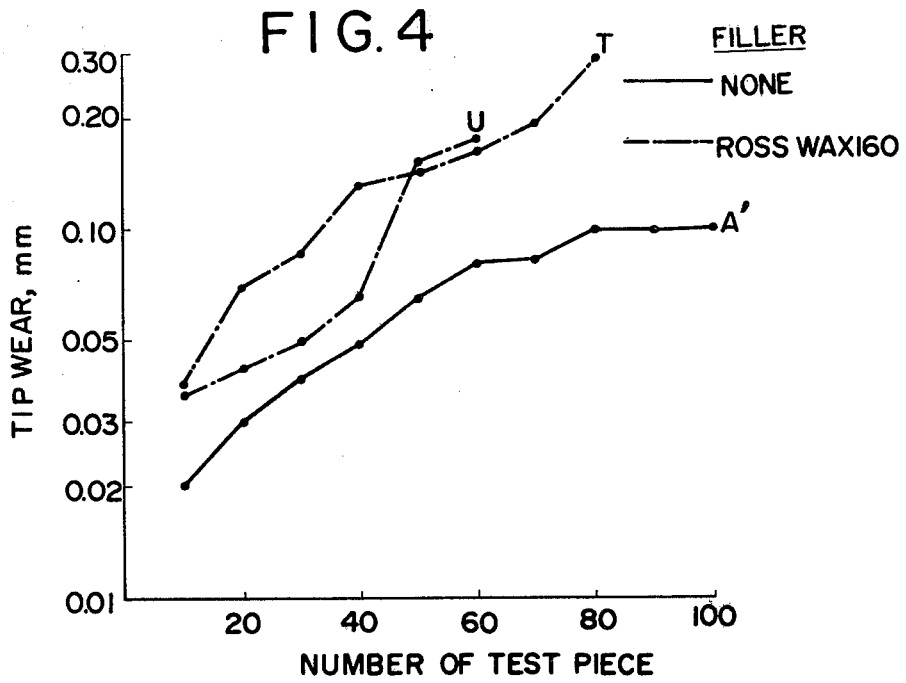
FIGS. 4 and 5 are graphs showing results of machinability testings on products prepared by the process of Example 1.
Figure 5:
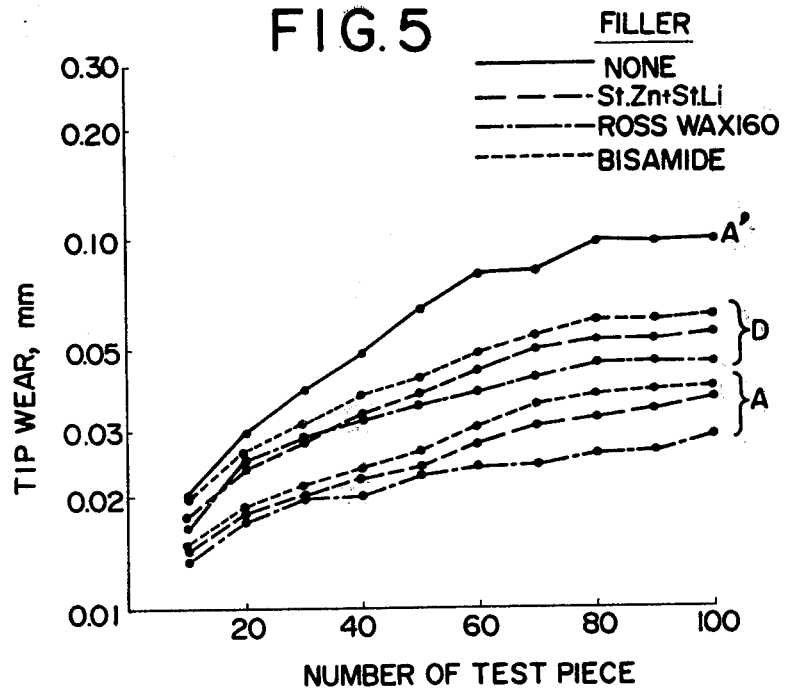

The testing apparatus is schematically shown in FIG. 3. Test sample shown by a reference numeral 1 is firmly held in a lathe chuck 3 and rotated at a cutting speed of 58 m/min and lead of 0.05 mm/rev with a chip mounted on a cutting tool 4, of K01-type stipulated in ISO 513 and having Form SNGN 432N stipulated in ISO 1832, and chamferred at its inner edge to a position shown in a broken line, and after every ten cuttings, machinability is evaluated by worn width produced on the relief surface of the chip. The test results are shown in FIG. 4. As seen in the graph even unfilled sample (designated by A')shows a lesser worn width which proves a superior machinability than the filled samples T and U. The second test is carried out on unfilled sample A' and filled Samples A and D using a various filler materials, and the results are shown in FIG. 5. The graph in FIG. 5 apparently show the effect of the infiltration.

EXAMPLE 2

Atomized 2C-30Cr-15W-Co powder (−100 Mesh) the composition of which being shown in Table 4 is admixed with graphite and molybdenum disulfide powders to give compositions as shown in Table 5. To the mixture, 0.7% of zinc stearate powder is added as a lubricant, and the mixed powder is compacted in a metal mold at a pressure of 6 t/cm sq. and then sintered in a vacuum for 50 minutes under a temperature of 1140° C. Rockwell hardness B and radial crushing strength of the resulting sintered product are shown in Table 5.

Table 4 (%)

| Type | Cr | Cr | W | Co |
|---|---|---|---|---|
| I | 2.5 | 33 | 12 | Balance |
| II | 2.5 | 33 | 20 | Balance |

Table 5

| Sample | C | Alloy Powder % | $MoS_2$ % | Fe | $HR_B$ | Radial Crushing Strength (Kg/mm sq.) |
|---|---|---|---|---|---|---|
| E | 1.2 | I: 10 | 0.3 | Balance | 82 | 63 |
| F | 1.2 | I: 10 | 1.0 | Balance | 83 | 57 |
| G | 1.2 | I: 20 | 0.5 | Balance | 81 | 52 |
| H | 1.2 | II: 10 | 0.3 | Balance | 84 | 75 |
| I | 1.2 | II: 15 | 0.3 | Balance | 86 | 68 |

Valve seats are prepared with these sample materials and tested under the similar manner as Example 1. The test results are shown in Table 6. Valve recession is measured in milli-meter.

Table 6

| Sample | 1st Cylinder | 2nd Cylinder | 3rd Cylinder | 4th Cylinder | Pitting |
|---|---|---|---|---|---|
| E | 0.05 | 0.05 | 0.07 | 0.04 | None |
| F | 0.03 | 0.06 | 0.05 | 0.02 | Slight |
| G | 0.03 | 0.05 | 0.05 | 0.03 | None |
| H | 0.04 | 0.03 | 0.06 | 0.04 | None |
| I | 0.02 | 0.04 | 0.03 | 0.03 | None |
| W | 0.08 | 0.12 | 0.11 | 0.09 | Observed |
| U | 0.05 | 0.08 | 0.09 | 0.06 | Observed |

In Table 6, Samples W and U are controls, the former comprising 1.0% C, 5.0% Mo, 2.0% Cr, and balance Fe, and the latter being the same as in Example 1. Both controls are iron-base alloys presently used as valve seat materials.

It is evident from Table 6 that the valve recession of the controls are larger than that of the sintered alloys of the present invention, and also slight or no pitting is observed in the latter.

Figure 6:
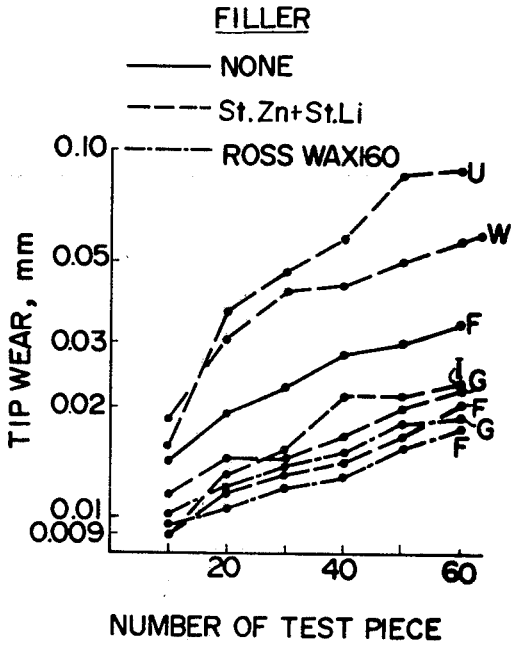
FIG. 6 is a similar graph of Example 2.

Machinability tests are carried out on Samples F, G, I, and control Samples W and U in accordance with the process as in Example 1. The results are shown in FIG. 6 together with the filler materials. The graphs in FIG. 6 prove the excellent machinability of the alloys of the present invention. Also, in comparing FIG. 6 with FIG. 5, improved machinability by the addition of sulphur to the alloys of Example 1 can apparently observed.

EXAMPLE 3

Powder compositions K, L and M as shown in the following Table 7 are prepared consisting of graphite of −325 Mesh, atomized 2C-30Cr-15W-Co alloy, low-carbon ferro-molybdenum of −100 Mesh, nickel carbonyl of less than 10 microns, cobalt of −325 Mesh and atomized iron powder. Said alloy is consisting of 2.5% C, 33.4% Cr., 11.5% W, 1.5% Si and balance Co, and said low-carbon ferro-molybdenum is consisting of 0.005% C, 1.0% Si, 66.0% Mo and balance Fe. To the above mixtures, 0.6% of zinc sterate powder is mixed as a lubricant, and the respective mixtures are compacted in a metal mold having its outer diameter of 38 mm and inner diameter of 29 mm, at a pressure of 5.5–6.5 t/cm sq. to obtain a density of 6.9±0.05 g/cc. The moldings are sintered in a vacuum oven for 40 minutes under a temperature of 1140° C. Chemical analysis and apparent hardness are shown in Table 8. For the purpose of comparison other samples N, X and Y are molded to have a density of 6.95±0.05 g/cc and sintered under the same conditions as Samples K, L and M in accordance with the present invention. Chemical compositions and apparent hardness of these sintered products are shown in the following Table 8.

Table 7 (%)

| Sample | Graphite | C-Cr-W-Co | Low-carbon Fe-Mo | Nickel Carbonyl | Co | Atomized Iron |
|---|---|---|---|---|---|---|
| K | 1.2 | 10 | 5 | 0.3 | 0 | Balance |
| L | 1.2 | 7.5 | 7.5 | 0.3 | 0 | Balance |
| M | 1.2 | 5 | 10 | 0.3 | 0 | Balance |
| N | 1.2 | 15 | 0 | 0.3 | 0 | Balance |
| X | 1.2 | 0 | 15 | 0.3 | 0 | Balance |
| Y | 1.2 | 0 | 15 | 0.3 | 5 | Balance |

Table 8 (%)

| Sample | C | Cr | Mo | W | Co | Ni | Hardness ($HR_B$) |
|---|---|---|---|---|---|---|---|
| K | 1.31 | 3.26 | 3.22 | 1.18 | 5.01 | 0.28 | 88 |
| L | 1.22 | 2.49 | 4.85 | 0.90 | 3.87 | 0.29 | 87 |
| M | 1.09 | 1.57 | 6.55 | 0.60 | 2.52 | 0.27 | 91 |
| N | 1.35 | 5.00 | — | 1.72 | 7.54 | 0.29 | 85 |
| X | 1.10 | — | 9.86 | — | — | 0.29 | 93 |
| Y | 1.05 | — | 9.86 | — | 4.96 | 0.23 | 91 |

Samples K, L and M are subject to filling or infiltrating process as described above, and Samples X and Y are listed as currently used valve seat alloys for comparison.

Valve seats are prepared with these alloys and subject to bench tests. In these test, the mating valve is made of 21–4N steel, (21Cr-4Ni-9Mn-0.5C-0.4N), cooling water temperature is 85°±5° C. lubricating oil temperature 110±5° C. These seats are inlaid on every cylinder head at a temperature of 140° C. under a pressure approximately 1 ton, but no oozing-out of filler material is found. The test results on the valve seat recession are shown in Table 9.

Table 9 (mm)

| Sample | 1st Cylinder | 2nd Cylinder | 3rd Cylinder | 4th Cylinder |
|---|---|---|---|---|
| K | 0 | 0.02 | 0.07 | 0.05 |
| L | 0.01 | 0.08 | 0.10 | 0.06 |
| M | 0.02 | 0.10 | 0.16 | 0.14 |
| N | 0 | 0.04 | 0.02 | 0.01 |
| X | 0.08 | 0.30 | 0.20 | 0.21 |
| Y | 0.10 | 0.15 | 0.35 | 0.21 |

The Table 9 evidently shows smaller recession of Samples K, L, M and N than that of Samples X and Y made of currently available valve seat alloys. As seen from the above Table 7, Samples K, L and M comprise progressively increasing alloy contents and progressively decreasing ferro-molybdenum contents. On the other hand, Table 9 reveals increasing larger recessions in the order of K, L and M. Considering, however, the general recession limit of 0.3 mm of valve seat, these Samples K, L and M will satisfy the practical durability requirement.

Figure 7:
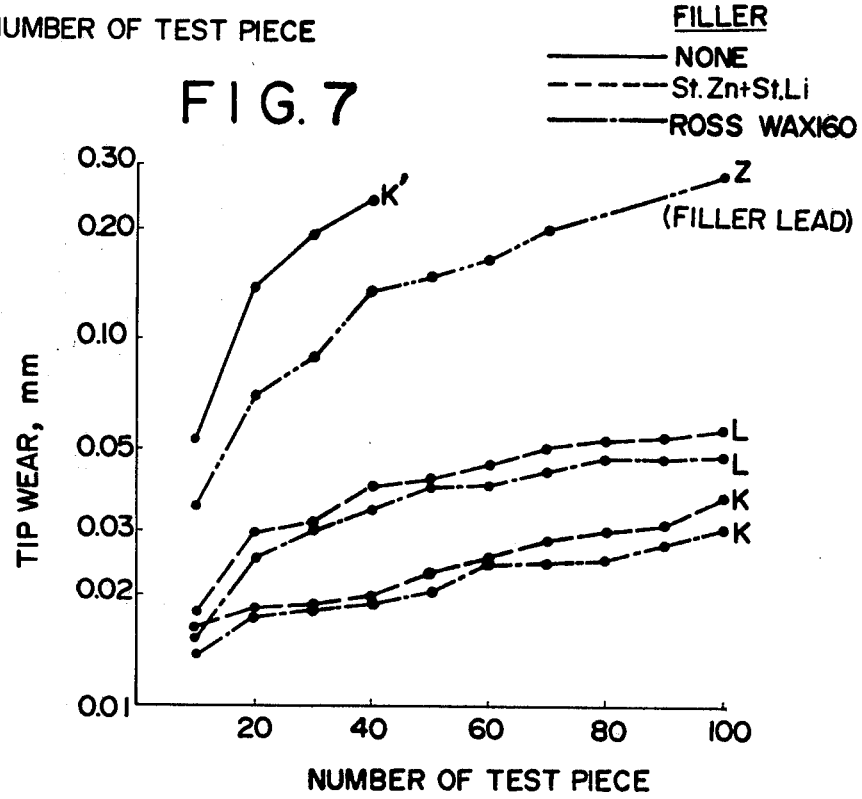
FIG. 7 is also a similar graph of Example 3.

Machinability tests on Samples K and L are carried out as previously described. The test results are shown in FIG. 7. In this figure, the worn width produced on cutting tools vs. number of cuttings are plotted for unfilled K (designated as K') and for another Sample Z comprising 0.8% C, 0.3% Mo, 0.1% W, 2.5% Cr, 0.7% Ni and balance Fe, and having a density of 6.8 g/cc and hardness of $HR_A$ of 58 and infiltrated with lead for the purpose of improved machinability. The lower four graphs apparently show the improved machinability by filling or infiltration of a wax or organic metallic compound. One important feature of the present invention is that a part of the expensive 2C-30Cr-15W-Co alloy may be replaced by less expensive molybdenum or ferr-molybdenum, which reduces the cost of raw material to approximately one-half. In this specification "Mesh" is based on Tyler system.

What is claimed is:

1. Wear resistant and machineable sintered iron-base alloy especially suitable for valve seat manufacture having chemical composition by weight of 0.6–1.5% carbon, 1.0–8.0% chromium, 0.25–4.0% tungsten, 2.0% cobalt and balance essentially iron, having a microstructure comprising pearlite and a globular hard alloy phase uniformly dispersed in said pearlite, said hard alloy phase being formed with atomized powder in a spherical form of pre-alloyed hard metal having a chemical composition by weight of 1.0–3.0% carbon, 20–40% chromium, 5–20% tungsten and 40–60% cobalt, wherein pores in said alloy are infiltrated with a filler material having a melting point in the range of 120° to 250° C., such as organic metallic compounds or waxes.

2. Sintered alloys as defined in claim 1 wherein said organic metallic compound is zinc stearate, lithium stearate or mixture thereof.

3. Sintered alloys as defined in claim 1 wherein said wax is Ross Wax 160 or Bisamide.

4. Method of producing a sintered iron-base alloy especially suitable for valve seat manufacture, comprising the steps of: mixing 5–20% by weight of pre-alloyed and atomized hard metal powder in a spherical form having a chemical composition by weight of 1.0–3.0% carbon, 20–40% chromium, 5–20% tungsten and 40–60% cobalt with 0.6–1.5% by weight of graphite powder and the remainder iron powder; compacting the mixture into a desired shape; and sintering the compacted shape at a temperature in the range of 1100° to 1180° C. for 30–60 minutes, said sintered product having a microstructure comprising pearlite and a globular hard alloy phase uniformly dispersed in said pearlite and having a chemical composition by weight of 0.6–1.5% carbon, 1.0–8.0% chromium, 0.25–4.0% tungsten, 2.0–12.0% cobalt and the balance essentially iron and, further comprising the step of infiltrating pores in the product by placing the product in a sealed chamber containing a molten bath of filler material having a melting point in the range of 120° to 250° C. such as organic metallic compounds or waxes, decreasing the pressure in said chamber to evacuate said pores, dipping the product into said bath, and then increasing the pressure above normal level.

5. Wear resistant and machineable sintered iron-base alloy especially suitable for valve seat manufacture having a chemical composition by weight of 0.6–1.5% carbon, 1.0–8.0% chromium, 0.5–4.0% tungsten, 2.0–12.0% cobalt, 0.04–0.4% sulphur and the balance essentially iron, having a microstructure comprising pearlite, a globular hard alloy phase and an iron sulfide phase uniformly dispersed in said pearlite, said hard alloy phase being formed with atomized powder in a spherical form of pre-alloyed hard metal having a chemical composition by weight of 1.0–3.0% carbon, 20–40% chromium, 5–20% tungsten and 40–60% cobalt, and wherein pores in said alloys are infiltrated with filler material having a melting point in the range of 120° to 250° C., such as organic metallic compounds or waxes.

6. Wear resistant and machineable sintered iron-base alloy especially suitable for valve seat manufacture having a chemical composition by weight of 0.6–1.5% carbon, 1.2–3.5% chromium, 0.2–2.0% tungsten, 2.0–7.0% cobalt, 3.0–8.0% molybdenum, 3.0% maximum nickel and the balance essentially iron, having a microstructure comprising pearlite, a globular hard alloy phase and an iron-molybdenum hard phase uniformly dispersed in said pearlite, said hard alloy phase being formed with atomized powder in a spherical form of pre-alloyed hard metal having a chemical composition by weight of 1.0–3.0%, 25–35% chromium, 5–20% tungsten and 40–70% cobalt, wherein pores in said alloy are infiltrated with a filler material having a melting point in the range of 120°–250° C., such as organic metallic compounds or waxes.

7. Method of producing sintered iron-base alloy especially suitable for valve seat manufacture, comprising the steps of: mixing 5–20% by weight of pre-alloyed and atomized hard metal powder in a spherical form having a chemical composition by weight of 1.0–3.0% carbon, 20–30% chromium, 5–20% tungsten and 40–60% cobalt with 0.6–1.5% by weight of graphite powder, 0.1–1.0% by weight of molybdenum disulfide powder and the remainder of iron powder; compacting the mixture into a desired shape; and sintering the compacted shape at a temperature in the range of 1100° to 1180° C. for 30–60 minutes, said sintered product having a microstructure comprising pearlite, a globular hard alloy phase and an iron sulfide phase uniformly dispersed in said pearlite, and having a chemical composition by weight of 0.6–1.5% carbon, 1.0–8.0% chromium, 0.5–4.0% tungsten, 2.0–12.0% cobalt, 0.04–0.4% sulphur and the balance essentially iron and further comprising the step of infiltrating pores in the product by: placing the product in a sealed chamber containing a molten bath of filler material having a melting point in the range of 120° to 250° C., such as organic metallic compounds or waxes, decreasing the pressure in said chamber to evacuate said pores, dipping the product into said bath, and then increasing the pressure above normal level.

8. Method of producing sintered iron-base alloy especially suitable for valve seat manufacture, comprising the steps of: mixing 5–10% by weight of pre-alloyed and atomized hard metal powder in a spherical form having chemical composition by weight of 1.0–3.0% carbon, 25–35% chromium, 5–20% tungsten and 40–70% cobalt with 0.6–1.5% by weight of graphite powder, 3–8% by weight of molybdenum powder or corresponding amount of low-carbon ferromolybdenum powder to give 3–8% by weight of molybdenum, and 3% maximum by weight of nickel, and further comprising the step of infiltrating pores in the product by placing the product in a sealed chamber containing a molten bath of filler material having a melting point in the range of 120° to 250° C., such as organic metallic compounds or waxes, decreasing the pressure in said chamber to evacuate said pores, dipping the product into said bath, and then increasing the pressure above normal level.

* * * * *